US005722272A

United States Patent [19]

Bridgeman et al.

[11] Patent Number: 5,722,272

[45] Date of Patent: Mar. 3, 1998

[54] VEHICLE DOOR LOCK ACTUATOR

[75] Inventors: Mark Bridgeman, Coventry; Jack Golar, Birmingham, both of England

[73] Assignee: Rockwell Light Vehicle Systems (Uk) Limited, Birmingham, United Kingdom

[21] Appl. No.: 676,158

[22] PCT Filed: Jan. 4, 1995

[86] PCT No.: PCT/GB95/00005

§ 371 Date: Jul. 10, 1996

§ 102(e) Date: Jul. 10, 1996

[87] PCT Pub. No.: WO95/18904

PCT Pub. Date: Jul. 13, 1995

[30] Foreign Application Priority Data

Jan. 11, 1994 [GB] United Kingdom ..... 9400425.6

[51] Int. Cl.[6] ..... E05B 53/00

[52] U.S. Cl. ..... 70/264; 70/275; 70/277

[58] Field of Search ..... 70/262, 263, 264, 70/275, 277, 237, 238, 239; 292/DIG. 3, DIG. 23, 201, 144, 142, 216

[56] References Cited

U.S. PATENT DOCUMENTS

| | | | |
|---|---|---|---|
| 4,364,249 | 12/1982 | Kleefeldt | 70/264 |
| 4,802,350 | 2/1989 | Periou | 292/201 |
| 4,974,886 | 12/1990 | Kleefeldt et al. | 70/264 |
| 5,046,769 | 9/1991 | Rimbey et al. . | |
| 5,052,731 | 10/1991 | Hayakawa et al. | 292/336.3 |
| 5,054,300 | 10/1991 | Nakahara et al. | 70/262 |
| 5,066,054 | 11/1991 | Ingenhoven | 292/201 |
| 5,078,436 | 1/1992 | Kleefeldt et al. | 70/264 |
| 5,092,638 | 3/1992 | Mizuki | 292/216 |
| 5,438,855 | 8/1995 | Ikeda | 292/216 |

FOREIGN PATENT DOCUMENTS

| | | |
|---|---|---|
| 0130726 | 1/1985 | European Pat. Off. . |
| 2222203 | 2/1990 | United Kingdom . |

*Primary Examiner*—Steven N. Meyers
*Assistant Examiner*—Tuyet-Phuong Pham
*Attorney, Agent, or Firm*—Learman & McCulloch

[57] ABSTRACT

A power operable door latch and lock mechanism for a vehicle having a central locking system includes a power actuator assembly including an actuating lever drivingly connected to blocking means of the mechanism, a main drive motor for selective powered movement of the lever between locked and unlocked positions, a manual locking lever for operative connection to a non-key controlled manually operable element, and a linkage serving to interconnect the manual lever and actuating lever for manual locking and unlocking independently of the drive motor. The linkage includes a sliding length connected at one end to the actuating lever and having a first guide slot accommodating a connecting pin of the linkage. A rocker arm of the manual locking lever has a second guide slot co-acting with the connecting pin with lost motion for selective transmission of movement of the manual lever to the linkage. The linkage further includes a superlocking lever having a third guide slot engaged with a pin, and positioned to shift the pin selectively in to and out of engagement with the manual lever to effectuate transmission to the link in a motor for selective powered movement of the superlocking lever.

3 Claims, 4 Drawing Sheets

VEHICLE DOOR LOCK ACTUATOR

Figure 1:
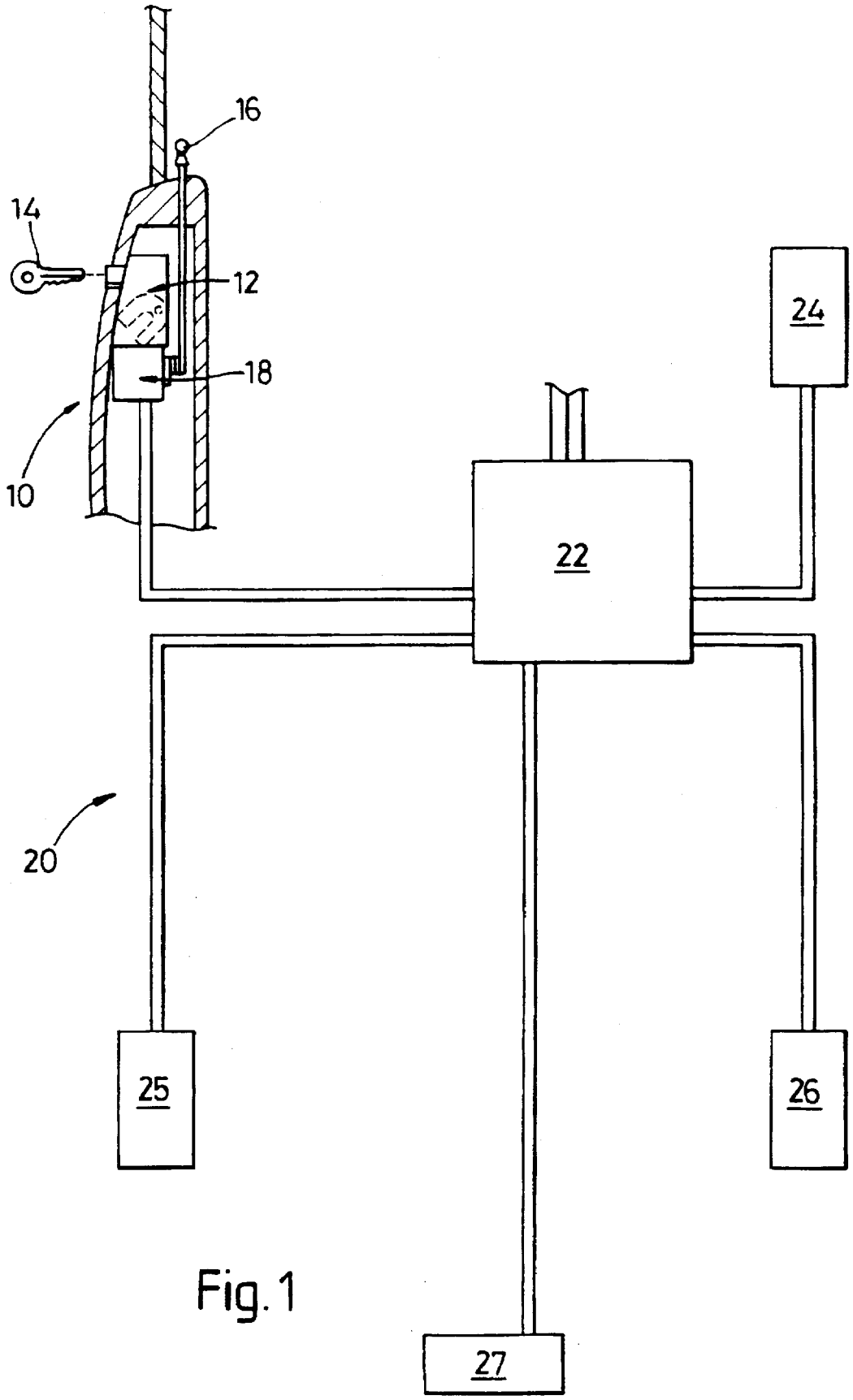

This invention relates to locking systems for vehicle doors and other closures of the kind in which the individual locks are interconnected through a central control unit for electrical actuation whereby locking or unlocking of all doors can be effected from a single control station actuated from within or outside the vehicle, herein referred to as "central locking systems"; and more specifically to the provision in said system of a power operated lock actuator incorporating a superlocking facility whereby the associated door latch cannot be freed from a locked condition even if access is gained to latch actuating elements within the vehicle e.g. the interior door handle or sill button as by breaking a window or probing into or through the door.

The object of the invention is to provide an actuator having a remotely controllable powered superlocking facility which is convenient and reliable in operation, which can be used in association with existing patterns of latch and locking mechanisms in substitution for known patterns of actuator unit, which provides a high standard of security against tampering and attempted unauthorised entry to the vehicle, and which is readily adaptable to a variety of modes of operation of central locking systems and with various arrangements for manual override by direct key actuation of the associated locking mechanism.

According to the invention there is provided a power actuator for use in combination with a door latch and lock mechanism of a vehicle having a central locking system, said actuator comprising:

(a) an actuator lever operatively drivingly connected to the lock mechanism in use, (b) a main drive motor for selective powered movement of said lever between locked and unlocked positions, (c) a manual locking lever for operative connection no a non-key controlled manual element (e.g. a sill button or internal door handle), and (d) linkage serving to interconnect said manual lever to the actuating lever for manual locking and unlocking independently of said drive motor, characterised in that a rocker arm of the manual locking lever is drive-connectable with the actuating lever through coupling means of said linkage including a drive dog selectively shiftable between an engaged position at which motion is transmitted between the two levers for locking and unlocking and a disengaged superlocking position at which the manual lever is free to move without displacement of the actuating lever from its locked position, the linkage further including a superlocking lever movement of which carries the drive dog into and out of its drive transmitting condition, and a superlocking motor for selective powered movement of the superlocking lever.

Conveniently said linkage includes an elongate sliding link connected at one end to an arm of the actuating lever and guided for longitudinal movement, said link defining a first guide slot extending generally laterally thereof; said drive dog being a floating connecting pin engaged in said first slot; an arm of the manual locking lever in overlapping relationship with the part of the link defining the first guide slot defining a second guide slot co-acting with the connecting pin and shaped to provide a lost motion portion extending co-axially of the manual lever axis whereby when the pin is in said portion motion of the manual lever is not transmitted through the linkage, and a narrow portion extending radially of the lever from the lost motion portion for close fitting motion transmitting engagement with the pin, the superlocking lever defining a third guide slot in engagement with the pin positioned to shift the latter selectively into and out of said narrow portion of the second guide slot but not restricting movement of the pin along the lost motion portion.

Preferably the linkage is arranged so that the superlocking can be manually overridden, as by key actuated unlocking of the associated lock mechanism, without actuation of the superlocking motor; and/or so that the manual lever is cammed to align with the drive as the superlocking lever shifts to the drive transmitting condition if the manual lever should have been misaligned therewith in the superlocking condition.

Figure 2:
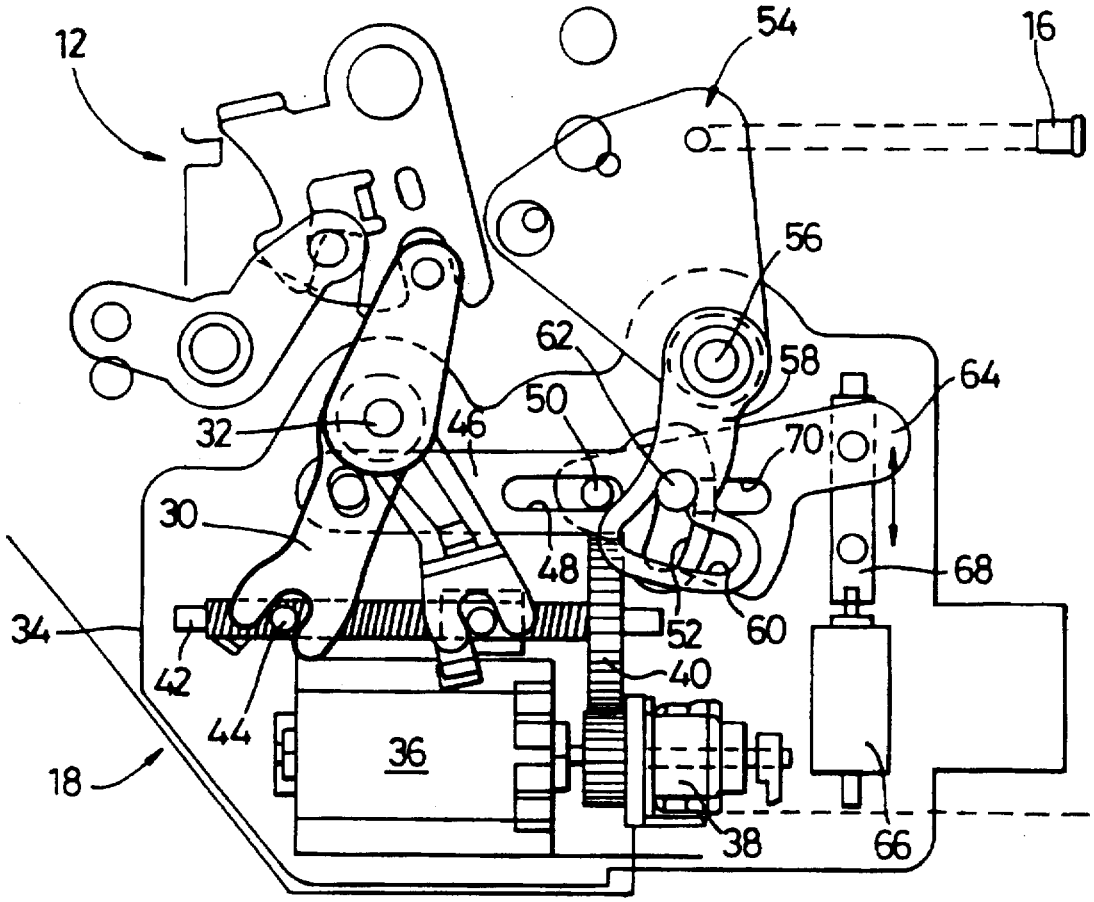
Figure 3:
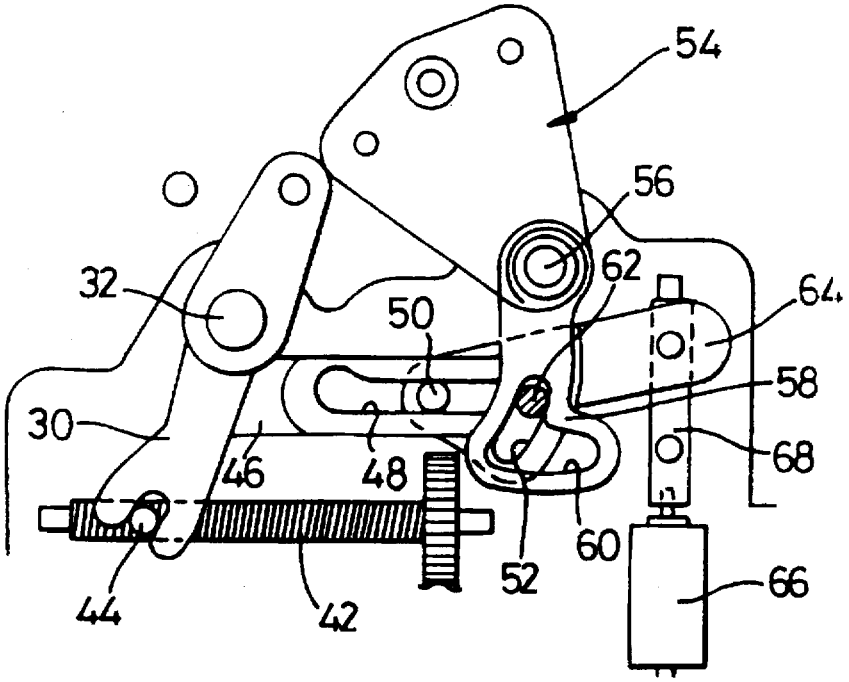
Figure 4:
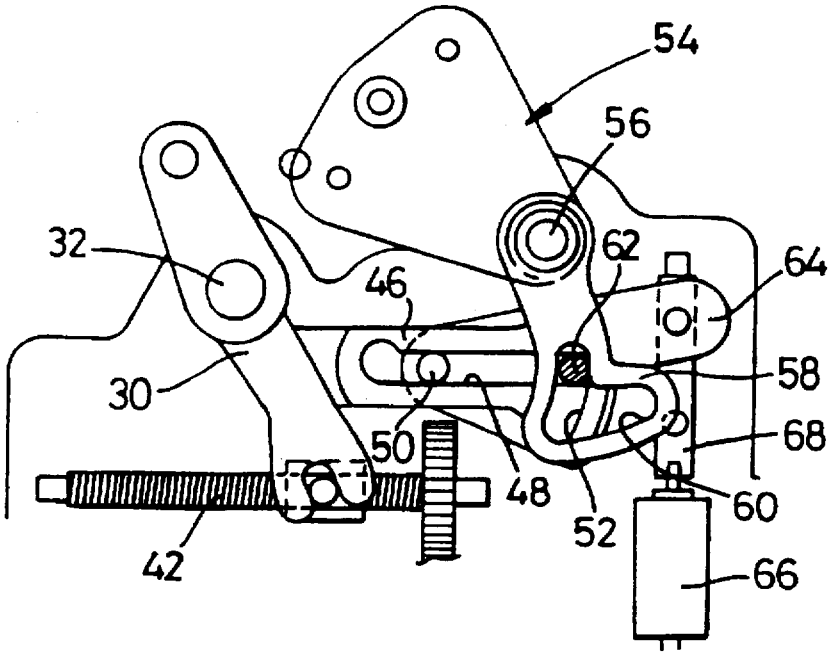
Figure 5:
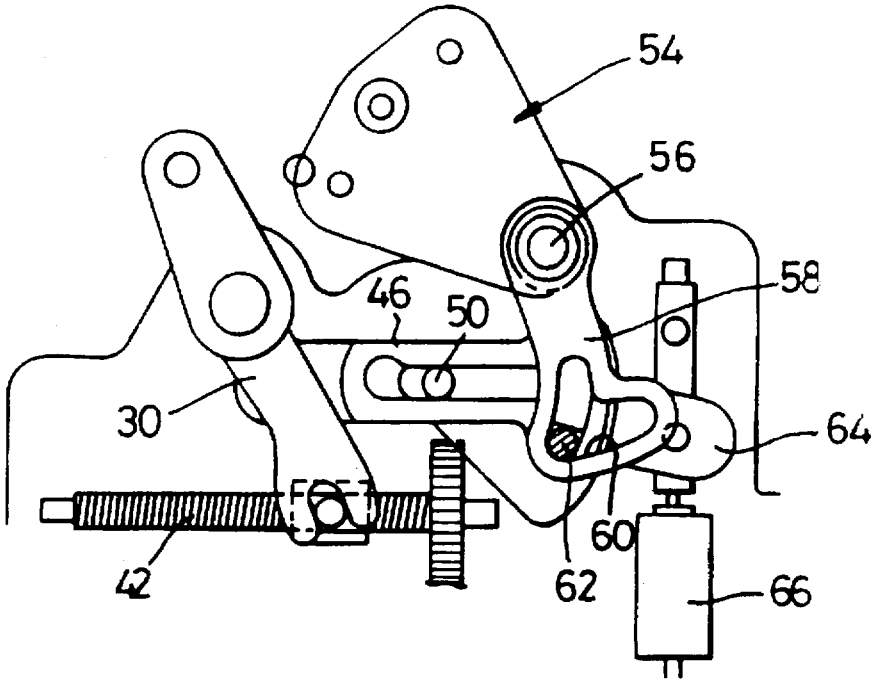
Figure 6:
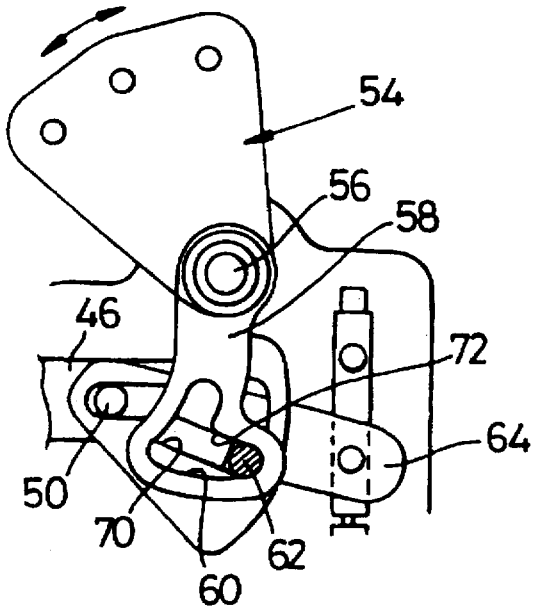

An example of the invention is now more particularly described with reference to the accompanying drawings, wherein:

FIG. 1 is a diagram of a vehicle central door locking system having a superlocking facility, FIG. 2 is a sectional view of part of a door latch and lock assembly and an associated powered actuator forming part of said system, shown in an unlocked state, FIG. 3 is a similar view showing only a linkage and directly associated parts of the actuator in said state, FIG. 4 is a like view to FIG. 3 but showing a locked state, FIG. 5 is a like view to FIGS. 3 and 4 but showing a superlocked state, and FIG. 6 shows a portion of the mechanism in another position of the superlocked state.

As is well known in the art a central door locking system provides powered locking of all the doors of a vehicle, and possibly other closures such as a boot lid, bonnet and/or petrol flap, simultaneously e.g. when the driver's or a passenger door is locked externally by manual operation of a key or possibly by a coded infra red or other remote control device, and it is known to incorporate a superlocking facility whereby unlocking cannot be effected by operation of the internal sill buttons, or door handles or by accessing the door interior to attempt to displace elements therein.

Parts of such a system are shown diagrammatically in FIG. 1 with part of one of the doors 10 depicted in more detail than the others. Door 10 includes a unitary door latch and lock mechanism 12 which can be directly locked and unlocked externally by use of a key 14 enabling release of its latch mechanism by the usual door handles (not shown). The door can also be manually locked and unlocked from the car interior by a conventional push-pull sill button 16 as referred to hereinafter.

Also mounted within door 10 in association with mechanism 12 is a powered actuator 18 operatively and electrically connected in a central locking control circuit 20 having a central control unit 22 and also connections to lock actuators 24–27 shown in block form only in the drawing, of other doors or closures of the vehicle.

The actuator 18 and its association with mechanism 12 is now described in detail with reference to FIGS. 2–6. FIG. 2 shows part only of lock mechanism 12 and it is omitted in the remaining figures as it is of generally conventional construction and operation.

Actuator 18 comprises an actuating lever 30 pivoted on a fixed stub shaft 32 mounted on a base plate 34, the latter forming part of an enclosed housing (not shown) of the actuator.

One arm of lever 30 projects from the housing to connect with and operate the lock mechanism, and lever 30 is selectively power-shifted between an unlocked position shown in heavy lines in FIG. 2 and a locked position to which it is turned anti-clockwise, shown in lighter lines in FIG. 2, by a main drive motor 36 of the actuator, the drive being transmitted from the latter through a conventional centrifugal clutch 38, a meshing pinion and gear wheel 40 and worm shaft 42 carrying a nut 44 engaging lever 30.

Actuator 18 further includes linkage comprising an elongate sliding link 46 pivotally connected at one end to lever 30 and guided by a longitudinal slot 48 engaging a fixed stud 50 for longitudinal reciprocal movement.

The end of link 46 remote from lever 30 is of increased width and defines an arcuate first guide slot 52 extending generally laterally of the link.

The sill button 16 of door 10 is not connected directly to the lock mechanism 12 as would usually be the case but is operatively connected to a manual locking lever 54 of actuator 18. Lever 54 is pivoted on another fixed stub shaft 56 and has a rocker arm 58 in overlapping relationship with the slotted end of link 46.

Arm 58 defines a second guide slot 60 which is generally L shaped, one limb of the slot constituting a narrow portion extending generally longitudinally of arm 58 in the direction of stub shaft 56 and the other limb extending generally laterally in an arc co-axial with the axis of said shaft to form a laterally wider lost motion portion at the outer end of said arm.

A drive dog in the form of a floating connecting pin 62 is engaged in both the first and second guide slots 52 and 60 and is axially captive therein but free for floating displacement in either or both slots depending on their relationship.

The positioning of pin 62 is further controlled by a superlocking lever 64 which has one end fulcrumed on fixed stud 50 with its major part also in overlapping relationship with the slotted end of link 46 and the slotted portion of rocker arm 58. The end of lever 64 remote from stud 50 projects beyond link 46 and is connected to a superlock motor 66 for selective powered actuation through another worm and nut 68, the direction of drive being generally at right angles to that of worm and nut 42, 44.

A median part of lever 64 defines a third guide slot 70 extending generally longitudinally of that lever and in which pin 62 is also engaged.

For better understanding of the drawings the sliding link 46 is shown in emphasized outline in FIG. 2; the superlocking lever 64 is shown likewise in FIG. 3. The rocker arm 58 of lever 54 is seen clearly in FIGS. 3–6 as it is uppermost.

In the unlocked state shown in FIGS. 2 and 3 actuating lever 30 is turned to its most clockwise position drawing link 46 to the left as viewed in the drawing. Superlocking lever 64 is held at its uppermost angular position as viewed in the drawings so that the third guide slot 70 is in line with longitudinal slot 48 of link 46 and this holds floating pin 62 in the narrow portion of the second guide slot 60 in rocker arm 58. In this position pin 62 connects arm 58 pivotally with link 46 so that there is positive drive transmission between them. Thus, if sill button 16 is operated to lock door 10 from the inside/locking lever 54 will be pivoted anti-clockwise pulling link 46 to the right and so shifting lever 30 to the locked position. Similarly if locking is effected by actuation of main drive motor 36 lever 30 will be powered to its locked position and at the same time the sill button will be drawn down by lever 54.

This locked (but not superlocked) state is illustrated in FIG. 4. In this state the lock can still be released by actuation of the sill button e.g. by an intruder breaking a window or "fishing" through a partly opened window and it is also possible that the lock could be released by inserting a probe into the door from the exterior to engage the connecting element between the sill button and the locked mechanism.

The substantial added security of superlocking is effected by actuation of superlocking motor 66, drawing lever 64 downwards from the FIGS. 2, 3 and 4 position to the position shown in FIGS. 5 and 6. This shifts pin 62 downwards as viewed in the drawings, carrying it along the arcuate first guide slot 52 of link 46 and longitudinally away from the axis of lever 54 so that it enters the laterally wide lost motion portion of the second guide slot 60.

In this position there is no drive connection between lever 54 and the remainder of the actuator linkage. Pin 62 cannot shift radially along lever 54 because of its engagement in the third guide slot 70 of lever 64. In the superlock state there is lost motion between lever 54 and the lock mechanism and angular displacement of the latter lever cannot release the lock. if the sill button should be moved while the actuator is in the superlocked state drawing lever 54 to the position shown in FIGS. 3 and 6, this could jam the superlocking lever 64 to prevent its displacement to the FIGS. 2–4 position. To ensure that this does not happen an edge part bounding second guide slot 60 and indicated at 72 in FIG. 6 is angled to provide a camming effect so that as pin 62 is urged upwards as seen in FIG. 6 by movement of lever 64 it will be urged to the left along slot 70 to return to the narrow portion of slot 70, restoring the locked or unlocked state of e.g. FIGS. 4 or 3.

If the power should fail or, for any reason, the central locking system should become inoperative with the actuator in the superlocked state the mechanism can still be overridden by manual actuation of the lock using the exterior key 14. On effecting unlocking in this way the mechanism is back driven, actuating lever 30 will be shifted to the unlocked position of FIG. 2, worm shaft 42 and the pinion of clutch 38 freewheeling, at the same time drawing link 46 to the left. This will cause pin 62 to ride up the third guide slot 70 of lever 64, i.e. shifting it to the left, even though the latter lever is still at the superlocked position and this will also turn manual locking lever 54 from its FIG. 5 position, at the same time displacing sill button 6.

The arrangement described effects selective and secure superlocking in a particularly simple and reliable manner, use of the separate superlocking motor 66 giving particularly positive operation and also providing flexibility of control by appropriate arrangement of circuit 20 of the central locking system and provision of sensing and other switches in or associated with the lock mechanisms and/or actuators in known manner (not shown in the drawings). Also, as the superlocking provision is self-contained within actuator 18 and the latter forms an individual unit no special adaptation of the door latch and lock mechanism 12 is required; actuators with or without the superlocking facility can be provided on different models of vehicle according to choice and demand and there is no need to build a "free wheeling" or lost motion provision into the mechanism of the lock or latch itself as this feature is incorporated in the actuator. Furthermore the sensing switches or contacts of the CDL system may readily be mounted in or provided on the housing of actuator 18, again providing flexibility of assembly according to requirements and adaptability to modification and provision of various operating arrangements. All the external electrical connections of the system required to each door can all be made, e.g. by a single multi-pole plug or connector, to actuator 18.

We claim:

1. Power operable door latch and lock mechanism for a vehicle having a central locking system, said mechanism including a power actuator assembly comprising:

a) an actuating lever drivingly connected to locking means of the mechanism;

b) a main drive motor for selective powered movement of said lever between locked and unlocked positions;

c) a manual locking lever for operative connection to a non-key controlled manually operable element; and d) a linkage interconnecting said manual lever to the said actuating lever for manual locking and unlocking independently of said drive motor, i) said linkage including an elongate link connected at one end to an arm of said actuating lever, guided for longitudinal movement, and defining a first guide slot extending generally laterally thereof, ii) said linkage further including a drive dog in the form of a floating connecting pin engaged in said first slot, a rocker arm of said manual locking lever being in overlapping relationship with the part of said link defining said first guide slot and defining a second guide slot co-acting with said pin and shaped to provide a lost motion portion extending co-axially of the axis of said manual locking lever, whereby positioning said pin in said lost motion portion provides a disengaged superlocking position at which motion of said manual lever is precluded from being transmitted through said linkage and to provide a narrow portion extending radially of said lever from the lost motion portion whereby positioning said pin in said narrow portion provides an engaged position at which motion is transmitted between the two levers for locking and unlocking, iii) said linkage further including a superlocking lever defining a third guide slot in engagement with said pin, and positioned to shift said pin selectively between said disengaged and engaged positions without restricting movement of said pin along said lost motion portion of said second guide slot; and iv) said mechanism including a superlocking motor for selective powered movement of said superlocking lever.

2. A mechanism as in claim 1 wherein said third guide slot is shaped to allow said pin to displace said lever from the superlocking position when said actuating lever is moved from the locked position independently of said linkage whereby, in use, the superlocking condition can be manually overridden by key actuated unlocking of the associated said lock mechanism, without actuation of said superlocking motor.

3. A mechanism as in claim 1 wherein said second guide slot is angled to provide a camming effect whereby movement of said manual locking lever will not jam said superlocking lever in the superlocked position.

* * * * *